US007470844B2

(12) United States Patent
Espina

(10) Patent No.: US 7,470,844 B2
(45) Date of Patent: Dec. 30, 2008

(54) MOUTHPIECE FOR MUSICAL INSTRUMENTS

(76) Inventor: Jody Espina, 811 Barnard St., Ground Floor, Savannah, GA (US) 31401

( * ) Notice: Subject to any disclaimer, the term of this patent is extended or adjusted under 35 U.S.C. 154(b) by 414 days.

(21) Appl. No.: 11/290,411

(22) Filed: Nov. 30, 2005

(65) Prior Publication Data

US 2006/0123973 A1 Jun. 15, 2006

Related U.S. Application Data

(60) Provisional application No. 60/635,456, filed on Dec. 13, 2004.

(51) Int. Cl.
*G10D 7/00* (2006.01)
*G10D 9/02* (2006.01)

(52) U.S. Cl. ..... 84/383 R; 84/382; 84/380 R; 84/383 A

(58) Field of Classification Search ..... 84/380 R, 84/383 R, 383 A, 382
See application file for complete search history.

(56) References Cited

U.S. PATENT DOCUMENTS

| | | | | | |
|---|---|---|---|---|---|
| 1,583,382 | A | | 5/1926 | Gauer | |
| 2,525,523 | A | * | 10/1950 | Chance | 84/383 R |
| 4,449,439 | A | * | 5/1984 | Wells | 84/383 R |
| 5,018,425 | A | * | 5/1991 | Rovner | 84/383 R |
| 5,293,805 | A | * | 3/1994 | Guardala et al. | 84/383 R |

* cited by examiner

*Primary Examiner*—Jeffrey Donels
*Assistant Examiner*—Christopher Uhlir
(74) *Attorney, Agent, or Firm*—Lerner, David, Littenberg, Krumholz & Mentlik, LLP

(57) ABSTRACT

Mouthpieces for use with single reed musical instruments are disclosed, including a main body with a tip at one end and a shank for attachment to the musical instrument at the other. The end of the main body including the tip has a closed side and a substantially flat side with a window surrounded by a table for placement of a reed thereon. The space between the closed side and the reed includes a tone chamber whose dimensions are defined by the golden ratio.

13 Claims, 3 Drawing Sheets

MOUTHPIECE FOR MUSICAL INSTRUMENTS

CROSS-REFERENCE TO RELATED APPLICATIONS

This application claims the benefit of the filing date of U.S. Provisional Patent Application No. 60/635,456 filed Dec. 13, 2004, the disclosure of which is hereby incorporated herein by reference.

BACKGROUND OF THE INVENTION

The present invention relates to a mouthpiece for use with a single reed musical instrument. More particularly, the present invention relates to a mouthpiece for a musical instrument having improved tone qualities and improved performance response.

The mouthpieces for single reed woodwind instruments are devices upon which a vibrating reed is normally mounted to the mouthpiece surface. In this manner, the tapered, thin end of the reed, which is quite flexible, functions as a reed valve. The reed opens and closes an opening in the mounting surface of the mouthpiece and therefore oscillates cooperatively with the vibrating air column of the instrument. The opening in the mouthpiece is normally referred to as a window.

One mouthpiece according to the prior art is disclosed in Rovner, U.S. Pat. No. 5,018,425. This mouthpiece is said to have improved tonal qualities. The mouthpiece shown in the Rovner patent thus includes a flat side front portion having a window 16 and a table 30 surrounding the window. The reed 40 thus extends over the window and part of the table and is held thereon with the ligature 20. The overall table used in Rovner is thus extremely small in proportion to the reed itself. While this mouthpiece has achieved significant success, it tends to favor an extremely bright and unstable sound, and diminishes the user's ability to produce dark tones when desired. Furthermore, in this case about 85% of the underside of the reed itself is exposed to the chamber 19 of the mouthpiece. This results in a mouthpiece that destabilizes the reed, and is thus difficult to control and more fatiguing for the player. Furthermore, the tone chamber 19 in this case is approximately the same length as the window 21 and is preferably rectangular or square in cross-section throughout its length. The configuration of this chamber introduces unpleasant partials to the tone not normally associated with traditional sounds.

Another mouthpiece is shown in Guardala et al., U.S. Pat. No. 5,293,805. This mouthpiece, as shown in FIGS. 3 and 4 thereof, includes a triangularly shaped recess 53 immediately overlying the vibrating reed, and in which the vibrating column of air striking these inner surfaces is said to result in the generation of fuller harmonic overtones.

Other conventional mouthpieces for musical instruments are shown in Chance, U.S. Pat. No. 2,525,523, and Bower, U.S. Pat. No. 1,583,382.

The search has continued, however, for an improved mouthpiece for single reed musical instruments which have improved tonal qualities and improved performance responses.

SUMMARY OF THE INVENTION

In accordance with the present invention, these and other objects have now been achieved by the discovery of a mouthpiece for use with a single reed musical instrument comprising a longitudinally extending main body having a longitudinal axis and including a first end and a second end, the first end of the longitudinally extending main body including a generally cylindrical shank for attachment to the musical instrument, the second end of the longitudinally extending main body having a tapered front portion having a first side and a second side, the first side being substantially flat and including a primary window extending from the second end of the longitudinally extending main body to a first predetermined point and a secondary window extending from the first predetermined point to a second predetermined point towards the first end of the longitudinally extending main body, the first side including a table for mounting the single reed, the table extending along the primary and secondary windows and having a substantially wider table surface in the area of the secondary window, the second side comprising a closed face defining a tone chamber extending the length of the primary window. Preferably, the width of the secondary window is substantially less than the width of the primary window.

In accordance with one embodiment of the mouthpiece of the present invention, the distance from the second end of the longitudinally extending main body to the first predetermined point is substantially the same as the distance from the first end of the longitudinally extending main body to the second predetermined point.

In accordance with another embodiment of the mouthpiece of the present invention, the distance from the second end to the second predetermined point is between about 55% and 65% of the distance from the first end to the second end.

In accordance with another embodiment of the mouthpiece of the present invention, the distance from the second end to the first predetermined point comprises from about 35% to 40% of the distance from the first end to the second end. In a preferred embodiment, the distance from the second end to the first predetermined point comprises from about 55% to 65% of the distance from the second end to the second predetermined point.

In accordance with the present invention, a mouthpiece has been discovered for use with a single reed musical instrument comprising a longitudinally extending main body having a longitudinal axis and including a first end and a second end, the first end of the longitudinally extending main body including a generally cylindrical shank for attachment to the musical instrument, the second end of the longitudinally extending main body including a tapered front portion having a first side and a second side, the first side being substantially flat and including an extended window comprising at least 50% of the distance from the first end to the second end of the longitudinally extending main body whereby sound waves are transmitted off the surface of the mouthpiece a plurality of times, thereby increasing the harmonics produced, the first side including a table for mounting the single reed, the table extending along the entire extended window, the second side comprising a closed face defining a tone chamber.

In accordance with one embodiment of the mouthpiece of the present invention, the extended window includes a primary window extending from the second end of the longitudinally extending main body to a first predetermined point and a second window extending from the first predetermined point to a second predetermined point towards the first end of the longitudinally extending main body. In a preferred embodiment, the distance from the second end of the longitudinally extending body to the first predetermined point is substantially the same as the distance from the first end of the longitudinally extending main body to the second predetermined point. Preferably, the width of the secondary window is substantially less than the width of the primary window.

In accordance with the present invention, a mouthpiece has also been discovered for use with a single reed musical instrument comprising a longitudinally extending main body having a longitudinal axis and including a first end and a second end, the first end of the longitudinally extending main body including a generally cylindrical shank for attachment to the musical instrument, the second end of the longitudinally extending body including a tapered front portion having a first side and a second side, the first side being substantially flat and including a primary window extending from the second end of the longitudinally extending main body to a first predetermined point and a secondary window extending from the first predetermined point to a second predetermined point towards the first end of the longitudinally extending main body, the ratio of the distance from the first end to the second end to the distance from the second end to the second predetermined point being substantially the same as the ratio of the distance from the second end to the second predetermined point to the distance from the second predetermined point to the first end, the first side including a table for mounting the single reed, the table extending along the primary and secondary windows and having a substantially wider table surface in the are of the secondary window, the second side comprising a closed face defining a tone chamber extending the length of the primary window.

In accordance with one embodiment of the mouthpiece of the present invention, the width of the secondary window is substantially less than the width of the primary window.

In accordance with the present invention, a mouthpiece has been discovered for use with a single reed musical instrument comprising a longitudinally extending main body having a longitudinal axis and including a first end and a second end, the first end including a generally cylindrical shank for attachment to the musical instrument, the second end of the longitudinally extending main body including a first portion having a first side and a second side, the first side being substantially flat and including a window extending from the second end of the longitudinally extending main body to a predetermined point, the first side including a table for mounting the single reed, the table extending along the window, the second side comprising a closed face defining a tone chamber extending the length of the window, the tone chamber comprising a plurality of dimensions defined by the golden ratio.

In accordance with one embodiment of the mouthpiece of the present invention, the window includes a primary window portion extending from the second end of the longitudinally extending main body to a first predetermined point and a secondary window portion extending from the first predetermined point to a second predetermined point comprising the predetermined point towards the first end of the longitudinally extending main body. Preferably, the width of the secondary window is substantially less than the width of the primary window.

In accordance with another embodiment of the mouthpiece of the present invention, the distance from the second end of the longitudinally extending main body to the first predetermined point is substantially the same as the distance from the first end of the longitudinally extending main body to the second predetermined point.

In accordance with another embodiment of the mouthpiece of the present invention, the distance from the second end to the second predetermined point is between about 55% and 65% of the distance from the first end to the second end. Preferably, the distance from the second end to the first predetermined point comprises from about 35% to 40% of the distance from the first end to the second end. In a preferred embodiment, the distance from the second end to the first predetermined point comprises from about 55% to 65% of the distance from the second end to the second predetermined point.

BRIEF DESCRIPTION OF THE DRAWINGS

The present invention will be more fully appreciated with reference to the following detailed description which, in turn, refers to the drawings wherein.

DETAILED DESCRIPTION

Figure 1:
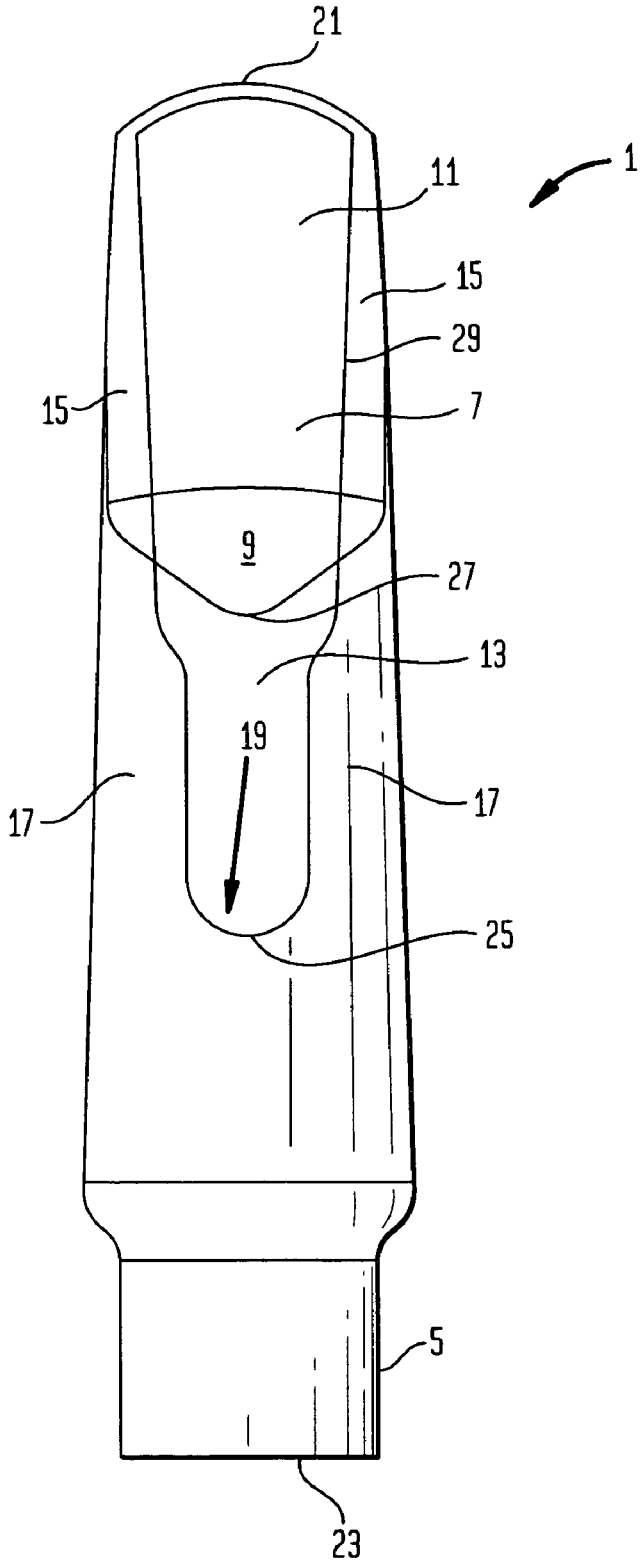
FIG. 1 is top, elevational view of a mouthpiece in accordance with the present invention.

Referring to the Figures, in which like reference numerals refer to corresponding portions thereof, FIG. 1 shows a mouthpiece in accordance with the present invention without the reed attached thereto. A mouthpiece for use with a single reed musical instrument can be molded, cast, or machined from various materials, including hard rubber, metal, plastic and wood to provide a longitudinal, generally conical body with a cylindrical shank for attachment to the musical instrument itself. The body thus includes a conical outer surface which merges with a generally planar surface on which a vibrating reed is mounted. The interior of the body includes a central bore with a forward wedge-shaped portion bounded by a curved upper wall and curved or planar side walls, and a relatively short conical lower wall, providing a tone chamber between the reed and the upper wall.

The dimensions of the tone chamber of the present invention are preferably determined in accordance with the golden ratio. That is, it is known that the golden ratio, referred to by the Greek letter Φ, is approximately 1.6180339887498948482. A golden rectangle, for example, is one with a ratio of length to width which equals the golden ratio. Thus, with a line segment A to C with a point B between A and C which is closer to A so that the ratio of the short segment AB to the long segment BC equals the ratio of the long segment BC to the entire segment AC, the ratio of the lengths of the two parts is the golden ratio. That is, this is the ratio of BC to AB. On the other hand, in a Fibonacci sequence, each terminus in the sequence is the sum of the two previous terms (e.g., 0, 1, 1, 2, 3, 5, 8, 13 . . . .) Along the sequence, the ratio of a term in the sequence to the one before, as one moves further down the sequence, gets closer to the golden ratio.

In designing the mouthpiece of the present invention, the golden ratio is an important element in determining the size and characteristics of the mouthpiece, and most particularly the tone chamber therein. Turning to FIG. 1, the mouthpiece 1 has a generally cylindrical shape with a tapered front portion which is substantially flat on one side 3 (see FIG. 3) leading to shank area 5 which is adapted for connection to the musical instrument itself in a conventional manner. The flat surface 3 of the front portion of the mouthpiece includes a window 7 which leads to a tone chamber 9 therewithin. Again, the dimensions of this chamber, as will be discussed in more detail below, are preferably based upon the golden ratio.

Returning to FIGS. 1 and 3, the window 7 is preferably divided into two portions including a first window portion 11 and a second window portion 13. The windows are defined by table portions surrounding the windows. These include first table portion 15 surrounding the first window portion 11 and second table portion 17 surrounding the second window portion 13. In this manner, a reed can extend over the window portions 11 and 13 and be mounted on table portions 15 and 17 of the mouthpiece 1. The reed is thus held in that position by a ligature (not shown) in a conventional manner. The tone chamber 9 is ultimately connected through a bore 19 to the shank portion 5 in the rear portion of the mouthpiece 1.

It is believed that by this use of an extended pair of windows, including the secondary window hereof which is smaller, or narrower, than the primary window, the reed is not destabilized, nor is it made difficult to control or more difficult or fatiguing to play the instrument. The table used herein thus influences the shape of the wave produced therein, by determining the length of the vibrating portion of the reed. Thus, a longer table favors a pause at the end of each phase, creating a tendency towards the square wave, which reinforces the uneven harmonics and produces a darker sound. Conversely, a shorter table will favor a rapid wave, thus creating a tendency toward the sine wave, which reinforces harmonics and produces a brighter sound. Use of a secondary window, which is narrower and thus includes wider side rails (tables), strikes a balance by introducing more harmonics through the use of less table surface, but by not proceeding too far; i.e., by providing an adequate table to give the performer more ability to control the sound.

As compared to the prior art, including the Rovner patent, the use of a window which has dimensions based upon the golden ratio, or which preferably has two distinct window sections as shown in FIG. 1, is an important element of the present invention. Thus, Rovner states that he has determined that tonal quality can be increased by extending the window to a proportion preferably up to about 85% of the length of the reed itself. The present invention relates to a discovery that improvements even over Rovner can be obtained. Thus, the use of a secondary window having large side rails acting as part of the table strikes an important balance by introducing more harmonics through the use of less table but by not going too far with this by having an adequate table to give the performer more ability to control the sound. Harmonics, by definition, are an element of timbre whose frequency is a whole multiple of that of the fundamental. For example, if the fundamental is 440, then the harmonics are 880, 1760, 3250, 7040, etc. all in Hz. Thus, Rovner's use of 85% of the underside of the reed being exposed to the tone chamber in the mouthpiece is far too great, and has resulted in a mouthpiece that destabilizes the reed, resulting in difficulty to control and more fatigue in playing. The tone chamber in Rovner is thus said to be preferably about the same length as the window itself and is preferably rectangular or square in cross-section throughout its length. This is believed to introduce unpleasant partials to the tonal quality or partials which are not normally associated with traditional instruments such as saxophones. Thus, the second window 13 in the present invention achieves exposure of the reed to a round bore which increases volume and harmonics as well as pleasing partials, but without altering the traditional sound of the instrument, such as a saxophone.

Turning again to FIG. 1, in a preferred embodiment relating to the mouthpiece for a tenor saxophone, the overall length of mouthpiece 1 extending from the end of curved end portion 21 to the end of the shank 5 at 23 will preferably be a total length of about 4.01 inches. It will be appreciated, however, that this overall length can change, particularly with respect to mouthpieces for other woodwind instruments, such as an alto saxophone (possibly about 85% of the size of the tenor saxophone mouthpiece), as well as soprano or baritone saxophones, or clarinets. The following example is thus based upon application of the golden ratio to this tenor saxophone embodiment, but it will be appreciated that the golden ratios can be applied to any other size mouthpiece. In the discussion which follows, when a particular dimensional figure is referred to as "about" a specified length, this figure is subject to an error range of ±0.05, primarily based on the fact that the mouthpiece products hereof are in many instances made by techniques which are not always exact or precise, including hand tooling, etc. Using Φ numbers which are based on the total distance of 4.01 inches, the distance from the end of the front tip 21 to the inner end of the second window 13 as designated by reference numeral 25 is about 2.47 inches. Once again, of course, if the total distance were a figure different from 4.01, the other distances would be altered accordingly. In any event, the distance from the tip end of the mouthpiece 21 to the point where the second window 13 begins as indicated by reference numeral 27, is about 1.53 inches. Finally, the distance from the end of the second window 13 as designated by reference numeral 25 to the end of shank portion 5 as designated by reference numeral 23 is also about 1.53 inches. It should be noted that based on an overall length of 4.01 inches the following are the Φ numbers associated therewith.

4.01
2.478316295
1.531683705
0.94663259
0.585051115
0.361581474
0.223469641
0.138111834
0.085357807
0.052754026
0.032603781
0.020150245
0.012453526
0.007696709
0.004756828
0.002939881

Another significant set of dimensions in accordance with the mouthpiece of the present invention relates to the relationships between these dimensions. That is, in one preferred embodiment, which again can be demonstrated with reference to FIG. 1, the ratio of the distance from the end of the shank portion 23 of the mouthpiece 1 to the tip 21 of the mouthpiece, to the distance from the tip 21 to the end of the secondary window 13 at point 25 is substantially the same as the ratio of the distance from the tip of the mouthpiece 21 to the end of the secondary window 13 at point 25 to the distance from the point 25 at the end of secondary window 13 to the end of the shank portion 23. This is yet another ratio of the component parts which adds to the realization of the overall benefits of the present invention. Once again, these dimensions, in conjunction with other elements of the present invention, such as the width of the secondary window being substantially less than the width of the primary window, adds to the benefits hereof.

Figure 3:
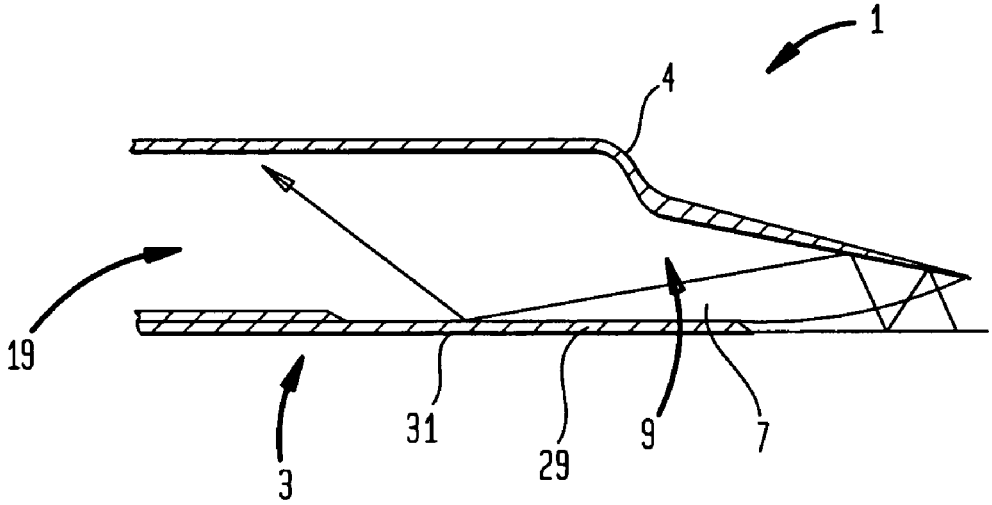
FIG. 3 is a side, elevational, cross-sectional view of the mouthpiece shown in FIG. 1.

Another significant dimension in connection with the mouthpiece of the present invention relates to the location where the table section 15 first begins to curve away from the reed as shown in FIGS. 1 and 3 and indicated by reference numeral 29. The distance from the tip 21 of the mouthpiece to a longitudinal location corresponding to point 29 is about 0.946 inches, and is sometimes referred to as the facing length. Furthermore, the width of the tone chamber 9 at this same point 29 should measure about 0.585 inches.

Figure 5:
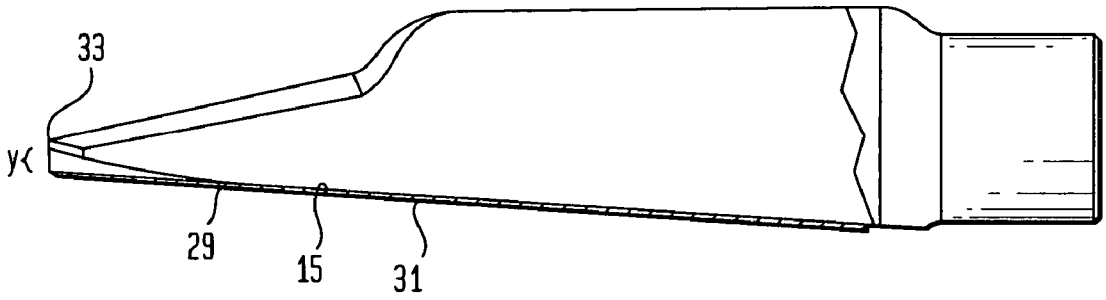
FIG. 5 is a side, elevational view of the mouthpiece shown in FIG. 1, in conjunction with a reed therefor.

Referring to FIG. 5, the facing length; i.e., from the point 29 where the reed 31 first touches the table section 15, in turn relates to the size of the tip opening 33; i.e., the distance Y between the tip 21 and the reed 31 at the tip end of the mouthpiece. The distance Y, however, can be varied for individual musicians; i.e., generally more experienced musicians will utilize a larger tip opening. However, alteration of the size of that tip opening will in turn alter the facing length. For example, the facing length of 0.946 inches referred to above relates to a relatively closed tip opening of 0.101 inches. On the other hand, a relatively more open tip opening of 0.108 inches will relate to a facing length of 0.9845 inches, and a relatively open tip opening of 0.116 inches will relate to a facing length of 1.02 inches.

The width of side rails 17 of the secondary window 13 as shown by dimension X is about 0.183 inches. Finally, the entire width of the table at the end point 25 of the secondary window 13 is about 0.585 inches.

Figure 4:
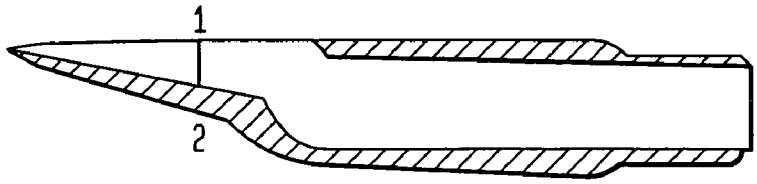
FIG. 4 is a side, elevational, cross-sectional view of another mouthpiece in accordance with the present invention.

Turning to FIG. 4, the depth of the chamber 9 at a point again corresponding to point 29 at the beginning of the facing portion is about 0.223 inches. Once again, however, this dimension will be altered as the size of the tip opening is altered, resulting in corresponding alteration of the facing length.

As can again be seen, each of these dimensions corresponds to a Φ number as set forth above. The use of the golden ratio to determine all of these dimensions has been found to be an important factor in obtaining the benefits of the present invention.

Figure 2:
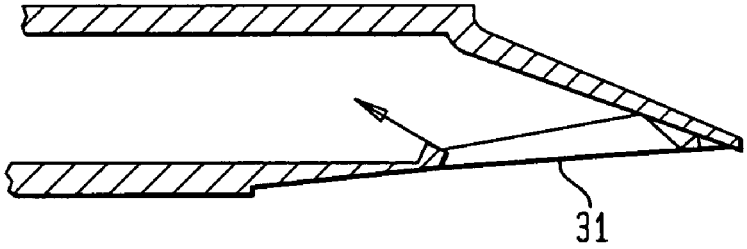
FIG. 2 is a side, elevational, cross-sectional view of a mouthpiece in accordance with the prior art.

In addition, referring to FIGS. 2 and 3, FIG. 2 shows normal wave transmission with a conventional mouthpiece of the prior art. As a general proposition, the reed, in association with the table of the mouthpiece, provides a generator for the column of air therein; i.e., it incites the vibration of that column of air. In this case, the sound waves are transmitted off the back of the reed 31 only one time before they extend into the tone chamber. On the other hand, referring to FIG. 3, normal sound waves are transmitted off the back of the reed 31 once and then at least a second time at a point with respect to the secondary window 13. At this point, there would normally be mouthpiece material as shown in FIG. 2, but in this case there is now more of the vibrating reed. This, in turn, incites the air column to increase vibration creating more harmonics and a larger sound. All of this is achieved in accordance with the mouthpiece of the present invention. Thus, in one embodiment, it has been discovered that the total length of the primary and secondary windows as shown, for example, in FIG. 1, from tip 21 to point 25, representing the end of the secondary window 13, should preferably comprise at least 50% of the total distance from the tip 21 to the end of the shank 23 for the mouthpiece itself. It has thus been found that this embodiment further assists in the sound waves being transmitted off the surface of the mouthpiece a plurality of times, thus increasing the harmonics produced therein. This is particularly so in the case of the configuration shown in FIG. 1 including both the primary and secondary window and again in the preferred embodiment discussed above in which the distance from the tip 21 to the point 27 where the primary window and the secondary window begins is substantially the same as the distance from the end of the shank portion 23 to point 25 where the secondary window ends. Of course, in this case, also as discussed above, the width of the secondary window is substantially less than the width of the primary window. As is stated in "The Saxophone Is My Voice," by Ernest Ferron, IMD 435, p. 27, "[a] saw tooth wave is produced by a vibrating body whose oscillations are unequal meaning that the positive phase is slower than the negative phase or vice versa. A saw tooth wave produces a sound rich in all types of harmonics meaning both even and uneven. A greater difference between the positive and negative phases will produce a more colorful sound that is rich in harmonics." Furthermore (id., p. 31), "[r]emember that, harmonics are the sound components whose frequencies are always whole multiples of the fundamental's frequency and partials are sound components outside that series. For example, a rough or coarse sound contains many partials."

Furthermore, increased projection of the sound of the musical instrument depends upon the presence of a group of harmonics to which the ear's midrange zone (e.g., 500 to 5000 Hz) responds. The use of the present invention, and particularly the preferred use of an extended, secondary window communicating with the tone chamber and the bore, adds harmonics within the ear's midrange zone.

By producing a mouthpiece in accordance with the present invention, particularly one based on Φ numbers as discussed above, a golden chamber is produced which increases harmonics and decreases partials.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A mouthpiece for use with a single reed musical instrument comprising a longitudinally extending main body having a longitudinal axis and a length of about 4 inches, and including a first end and a second end, said first end of said longitudinally extending main body including a generally cylindrical shank for attachment to said musical instrument, said second end of said longitudinally extending main body having a tapered front portion having a first side and a second side, said first side being substantially flat and including a primary window extending from said second end of said longitudinally extending main body to a first predetermined point disposed about 1.53 inches from said second end and a secondary window extending from said first predetermined point to a second predetermined point towards said first end of said longitudinally extending main body disposed about 2.47 inches from said first predetermined point, said first side including a table for mounting said single reed, said table extending along said primary and secondary windows and having a substantially wider table surface in the area of said secondary window, said second side comprising a closed face defining a tone chamber extending the length of said primary chamber.

2. The mouthpiece of claim 1 wherein the width of said secondary window is substantially less than the width of said primary window.

3. The mouthpiece of claim 1 wherein the distance from said second end of said longitudinally extending main body to said first predetermined point is substantially the same as the distance from said first end of said longitudinally extending main body to said second predetermined point.

4. The mouthpiece of claim 1 wherein the distance from said second end to said second predetermined point is between about 55% and 65% of said distance from said first end to said second end.

5. The mouthpiece of claim 1 wherein the distance from said second end to said first predetermined point comprises from about 35% to 40% of the distance from said first end to said second end.

6. The mouthpiece of claim 5 wherein the distance from said second end to said first predetermined point comprises from about 55% to 65% of the distance from said second end to said second predetermined point.

7. A mouthpiece for use with a single reed musical instrument comprising a longitudinally extending main body having a longitudinal axis, and including a first end and a second end, said first end of said longitudinally extending main body including a generally cylindrical shank for attachment to said musical instrument, said second end of said longitudinally extending main body including a first portion having a first side and a second side, said first side being substantially flat and including a window extending from said second end of said longitudinally extending main body to a predetermined point, said first side including a table for mounting said single reed, said table extending along said window, said second side comprising a closed face defining a tone chamber extending the length of said window, said tone chamber comprising a plurality of dimensions defined by the golden ratio.

8. The mouthpiece of claim 7 wherein said window includes a primary window portion extending from said second end of said longitudinally extending main body to a first predetermined point and a secondary window portion extending from said first predetermined point to a second predetermined point comprising said predetermined point towards said first end of said longitudinally extending main body.

9. The mouthpiece of claim 8 wherein the width of said secondary window is substantially less than the width of said primary window.

10. The mouthpiece of claim 8 wherein the distance from said second end of said longitudinally extending main body to said first predetermined point is substantially the same as the distance from said first end of said longitudinally extending main body to said second predetermined point.

11. The mouthpiece of claim 8 wherein the distance from said second end to said second predetermined point is between about 55% and 65% of said distance from said first end to said second end.

12. The mouthpiece of claim 8 wherein the distance from said second end to said first predetermined point comprises from about 35% to 40% of the distance from said first end to said second end.

13. The mouthpiece of claim 8 wherein the distance from said second end to said first predetermined point comprises from about 55% to 65% of the distance from said second end to said second predetermined point.

* * * * *